US008076566B2

(12) United States Patent
Yamashita et al.

(10) Patent No.: US 8,076,566 B2
(45) Date of Patent: Dec. 13, 2011

(54) BEAT EXTRACTION DEVICE AND BEAT EXTRACTION METHOD

(75) Inventors: Kosei Yamashita, Kanagawa (JP); Yasushi Miyajima, Kanagawa (JP)

(73) Assignee: Sony Corporation, Tokyo (JP)

( * ) Notice: Subject to any disclaimer, the term of this patent is extended or adjusted under 35 U.S.C. 154(b) by 582 days.

(21) Appl. No.: 12/161,882

(22) PCT Filed: Jan. 24, 2007

(86) PCT No.: PCT/JP2007/051073

§ 371 (c)(1), (2), (4) Date: Oct. 3, 2008

(87) PCT Pub. No.: WO2007/086417

PCT Pub. Date: Aug. 2, 2007

(65) Prior Publication Data

US 2009/0056526 A1 Mar. 5, 2009

(30) Foreign Application Priority Data

Jan. 25, 2006 (JP) ..... 2006-016801

(51) Int. Cl.
*G10H 1/40* (2006.01)

(52) U.S. Cl. ..... 84/611

(58) Field of Classification Search ..... 84/611, 84/635, 651, 667, 713, 612, 636, 652, 668, 84/714; 700/94

See application file for complete search history.

(56) References Cited

U.S. PATENT DOCUMENTS

| | | | | |
|---|---|---|---|---|
| 2002/0148347 | A1* | 10/2002 | Herberger et al. | 84/636 |
| 2002/0172372 | A1* | 11/2002 | Tagawa et al. | 381/56 |
| 2003/0065517 | A1* | 4/2003 | Miyashita et al. | 704/278 |
| 2005/0071329 | A1* | 3/2005 | Weare | 707/3 |

FOREIGN PATENT DOCUMENTS

| | | |
|---|---|---|
| JP | 6 290574 | 10/1994 |
| JP | 3066528 | 5/2000 |
| JP | 2000 267655 | 9/2000 |
| JP | 2002 116754 | 4/2002 |
| JP | 2002 278547 | 9/2002 |
| JP | 2003 108132 | 4/2003 |
| JP | 2003 263162 | 9/2003 |
| JP | 2004 233965 | 8/2004 |
| JP | 2004 528596 | 9/2004 |
| JP | 2007 33851 | 2/2007 |

* cited by examiner

*Primary Examiner* — Jeffrey Donels
*Assistant Examiner* — Andrew R Millikin
(74) *Attorney, Agent, or Firm* — Oblon, Spivak, McClelland, Maier & Neustadt, L.L.P.

(57) ABSTRACT

Upon receiving a digital audio signal recorded in a .wav file, a beat extraction processing unit 12 extracts coarse beat position information from this digital audio signal and outputs the result as metadata recorded in an .mty file. In addition, a beat alignment processing unit 13 aligns beat information of the metadata recorded in the .mty file and outputs the result as metadata recorded in a .may file. Beats of a rhythm of music are extracted highly accurately while reproducing a music signal of a musical tune.

16 Claims, 12 Drawing Sheets

(A) TIME-SERIES WAVEFORM (B) SPECTRO-GRAM (A) TIME-SERIES WAVEFORM (B) SPECTRO-GRAM (C) EXTRACTED BEAT WAVEFORM

BEAT EXTRACTION DEVICE AND BEAT EXTRACTION METHOD

TECHNICAL FIELD

The present invention relates to a beat extracting device and a beat extracting method for extracting beats of a rhythm of music.

BACKGROUND ART

A musical tune is composed on the basis of a measure of time, such as a bar and a beat. Accordingly, musicians play a musical tune using a bar and a beat as a basic measure of time. When taking a timing of playing of a musical tune, musicians play the musical tune using a method of making a specific sound at a certain beat of a certain bar but never play it using a timestamp-employing method of making a specific sound certain minutes and certain seconds after starting to play. Since music is defined by bars and beats, musicians can flexibly deal with a fluctuation in a tempo and a rhythm. In addition, each musician can express their originality in the tempo and the rhythm in a performance of an identical musical score.

A performance carried out by musicians is ultimately delivered to users as music content. More specifically, the performance of each musician is mixed down, for example, in a form of two channels of stereo and is formed into one complete package. This complete package is delivered to users, for example, as a music CD (Compact Disc) employing a PCM (Pulse Code Modulation) format. The sound source of this music CD is referred to as a so-called sampling sound source.

In a stage of a package of such a CD or the like, information regarding timings, such as bars and beats, which musicians are conscious about, is missing.

However, humans can naturally re-recognize the information regarding timings, such as bars and beats, by only listening to an analog sound obtained by performing D/A (Digital to Analog) conversion on an audio waveform in this PCM format. That is, humans can naturally regain a sense of musical rhythm. On the other hand, machines do not have such a capability and only have the time information of a timestamp that is not directly related to the music itself.

As an object to be compared with such a musical tune provided by a performance by musicians or by a voice of singers, there is a conventional karaoke system. This system displays lyrics in synchronization with the rhythm of music on a karaoke display screen.

However, such a karaoke system does not recognize the rhythm of music but simply reproduces dedicated data called MIDI (Music Instrument Digital Interface).

Performance information and lyric information necessary for synchronization control and time code information (timestamp) describing a timing (event time) of sound production are described in a MIDI format as MIDI data. The MIDI data is created in advance by a content creator. A karaoke playback apparatus only performs sound production at a predetermined timing in accordance with instructions of the MIDI data. That is, the apparatus generates (plays) a musical tune on the moment. This can be enjoyed only in a limited environment of MIDI data and a dedicated apparatus therefor.

Furthermore, although various formats, such as SMIL (Synchronized Multimedia Integration Language), exist in addition to the MIDI, the basic concept is the same.

Meanwhile, a format mainly including a raw audio waveform called the sampling sound source described above, such as, for example, PCM data represented by CDs or MP3 (MPEG (Moving Picture Experts Group) Audio Layer 3) that is compressed audio thereof, is the mainstream of music content distributed in the market rather than the MIDI and the SMIL.

A music playback apparatus provides the music content to users by performing D/A conversion on these sampled audio waveforms of PCM or the like and outputting them. In addition, as seen in FM radio broadcasting or the like, there is an example in which an analog signal of a music waveform itself is broadcasted. Furthermore, there is an example in which a person plays music on the moment, such as in a concert and a live performance, and the music content is provided to users.

If a machine could automatically recognize a timing, such as a bar and a beat of music, from a raw music waveform of the music, a synchronization function allowing music and another medium, as in karaoke and dance, to be rhythm-synchronized can be realized even if there is no prepared information, such as event time information of the MIDI and the SMIL. Furthermore, regarding massive existing content, such as CDs, possibilities of a new entertainment broaden.

Hitherto, attempts to automatically extract a tempo or beats have been made.

For example, in Japanese Unexamined Patent Application Publication No. 2002-116754, a method is disclosed in which a self-correlation of a music waveform signal serving as a time-series signal is calculated, a beat structure of the music is analyzed on the basis of this calculation result, and a tempo of the music is further extracted on the basis of this analysis result.

In addition, in Japanese Patent No. 3066528, a method is described in which sound pressure data for each of a plurality of frequency bands is created from musical tune data, a frequency band at which the rhythm is most noticeably taken is specified from the plurality of frequency bands, and rhythm components are estimated on the basis of a cycle of the change in the sound pressure data of the specified frequency timing.

Techniques for calculating the rhythm, the beat, and the tempo are broadly classified into those for analyzing a music signal in a time domain as in the case of Japanese Unexamined Patent Application Publication No. 2002-116754 and those for analyzing a music signal in a frequency domain as in the case of Japanese Patent No. 3066528.

However, in the method of Japanese Unexamined Patent Application Publication No. 2002-116754 for analyzing a music signal in a time domain, high extraction accuracy cannot be obtained essentially since the beat and the time-series waveform do not necessarily match. In addition, the method of Japanese Patent No. 3066528 for analyzing a music signal in a frequency domain can relatively improves the extraction accuracy than Japanese Unexamined Patent Application Publication No. 2002-116754. However, data resulting from the frequency analysis contains many beats other than beats of a specific musical note and it is extremely difficult to separate the beats of the specific musical note from all of the beats. In addition, since the musical tempo (time period) itself fluctuates greatly, it is extremely difficult to extract only the beats of the specific musical note while keeping track of these fluctuations.

Accordingly, it is impossible to extract beats of a specific music note that temporally fluctuate over an entire musical tune with conventional techniques.

The present invention is suggested in view of such conventional circumstances. It is an object of the present invention to provide a beat extracting device and a beat extracting method capable of extracting only beats of a specific musical note highly accurately over an entire musical tune regarding the musical tune whose tempo fluctuates.

To achieve the above-described object, a beat extracting device according to the present invention is characterized by including beat extraction processing means for extracting beat position information of a rhythm of a musical tune, and beat alignment processing means for generating beat period information using the beat position information extracted and obtained by the beat extraction processing means and for aligning beats of the beat position information extracted by the beat extraction processing means on the basis of the beat period information.

In addition, to achieve the above-described object, a beat extracting method according to the present invention is characterized by including a beat extraction processing step of extracting beat position information of a rhythm of a musical tune, and a beat alignment processing step of generating beat period information using the beat position information extracted and obtained at the beat extraction processing step and of aligning beats of the beat position information extracted by the beat extraction processing means on the basis of the beat period information.

BRIEF DESCRIPTION OF DRAWINGS

FIG. 3(A) is a diagram showing an example of a time-series waveform of a digital audio signal, whereas FIG. 3(B) is a diagram showing a spectrogram of this digital audio signal.

FIG. 6(A) is a diagram showing beat intervals of beat position information extracted by a beat extraction processing unit, whereas FIG. 6(B) is a diagram showing beat intervals of beat position information that is alignment-processed by a beat alignment processing unit.

BEST MODES FOR CARRYING OUT THE INVENTION

In the following, specific embodiments to which the present invention is applied will be described in detail with reference to the drawings.

Figure 1:
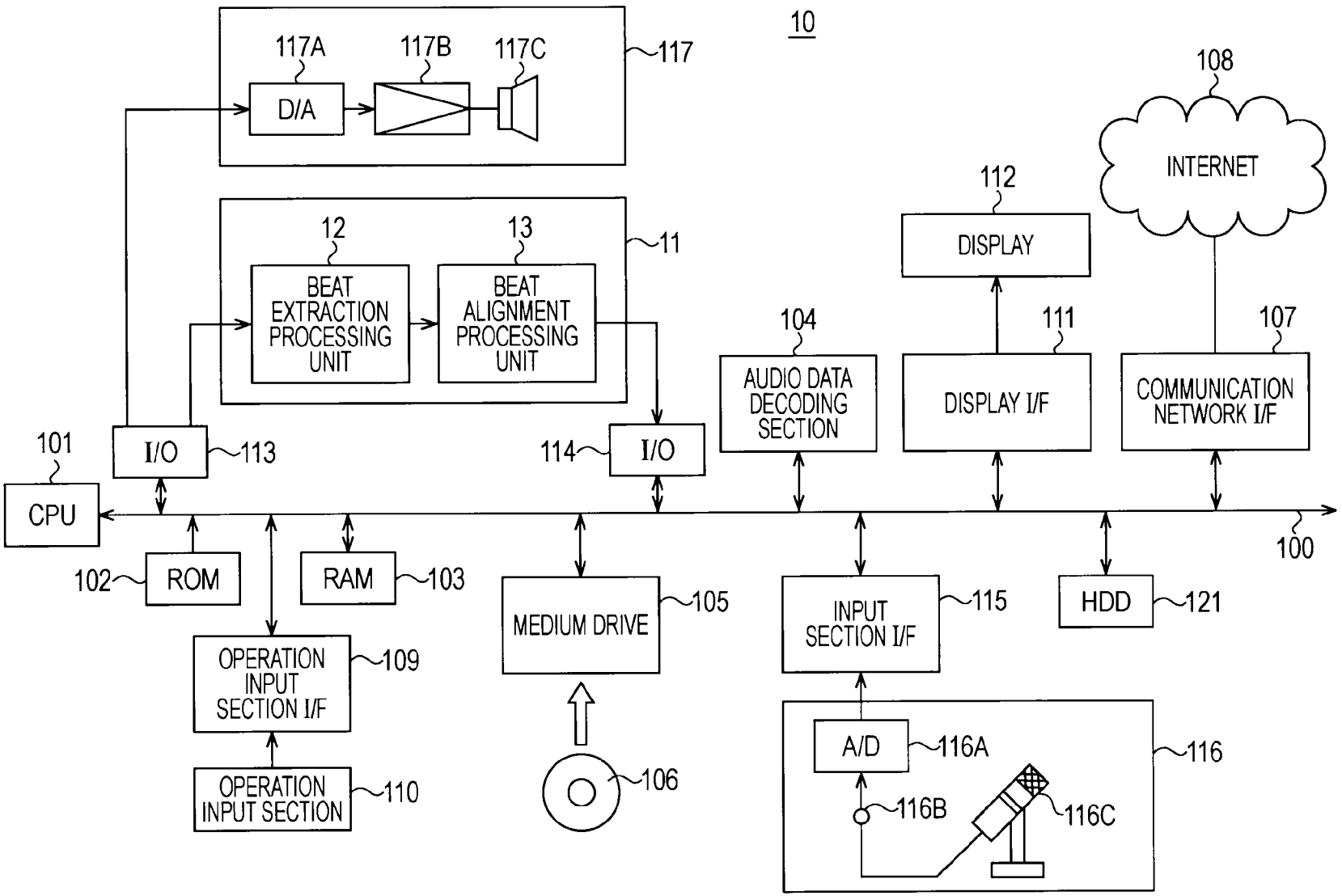
FIG. 1 is a functional block diagram showing an internal configuration of a music playback apparatus including an embodiment of a beat extracting device according to the present invention.

FIG. 1 is a block diagram showing an internal configuration of a music playback apparatus 10 including an embodiment of a beat extracting device according to the present invention. The music playback apparatus 10 is constituted by, for example, a personal computer.

In the music playback apparatus 10, a CPU (Central Processing Unit) 101, a ROM (Read Only Memory) 102, and a RAM (Random Access Memory) 103 are connected to a system bus 100. The ROM 102 stores various programs. The CPU 101 executes processes based on these programs in the RAM 103 serving as a working area.

Also connected to the system bus 100 are an audio data decoding section 104, a medium drive 105, a communication network interface (The interface is shown as I/F in the drawing. The same applies to the following.) 107, an operation input section interface 109, a display interface 111, an I/O port 113, an I/O port 114, an input section interface 115, and an HDD (Hard Disc Drive) 121. A series of data to be processed by each functional block is supplied to another functional block through this system bus 100.

The medium drive 105 imports music data of music content recorded on a medium 106, such as a CD (Compact Disc) or a DVD (Digital Versatile Disc), to the system bus 100.

An operation input section 110, such as a keyboard and a mouse, is connected to the operation input section interface 109.

It is assumed that a display 112 displays, for example, an image synchronized with extracted beats and a human figure or a robot that dances in synchronization with the extracted beats.

An audio reproducing section 117 and a beat extracting section 11 are connected to the I/O port 113. In addition, the beat extracting section 11 is connected to the I/O port 114.

An input section 116 including an A/D (Analog to Digital) converter 116A, a microphone terminal 116B, and a microphone 116C is connected to the input section interface 115. An audio signal and a music signal picked up by the microphone 116C are converted into a digital audio signal by the A/D converter 116A. The digital audio signal is then supplied to the input section interface 115. The input section interface 115 imports this digital audio signal to the system bus 100. The digital audio signal (corresponding to a time-series waveform signal) imported to the system bus 100 is recorded in the HDD 121 in a format of .wav file or the like. The digital audio signal imported through this input section interface 115 is not directly supplied to the audio reproducing section 117.

Upon receiving music data from the HDD 121 or the medium drive 105 through the system bus 100, the audio data decoding section 104 decodes this music data to restore the digital audio signal. The audio data decoding section 104 transfers this restored digital audio signal to the I/O port 113 through the system bus 100. The I/O port 113 supplies the digital audio signal transferred through the system bus to the beat extracting section 11 and the audio reproducing section 117.

The medium 106, such as an existing CD, is imported to the system bus 100 through the medium drive 105. Uncompressed audio content acquired through download or the like by a listener and to be stored in the HDD 121 is directly imported to the system bus 100. On the other hand, compressed audio content is returned to the system bus 100 through the audio data decoding section 104. The digital audio signal (the digital audio signal is not limited to a music signal and includes, for example, a voice signal and other audio band signals) imported to the system bus 100 from the input section 116 through the input section interface 115 is also returned to the system bus 100 again after being stored in the HDD 121.

In the music playback apparatus 10 in one embodiment to which the present invention is applied, the digital audio signal (corresponding to a time-series waveform signal) imported to the system bus 100 is transferred to the I/O port 113 and then is supplied to the beat extracting section 11.

The beat extracting section 11 that is one embodiment of a beat processing device according to the present invention includes a beat extraction processing unit 12 for extracting beat position information of a rhythm of a musical tune and a beat alignment processing unit 13 for generating beat period information using the beat position information extracted and obtained by the beat extraction processing unit 12 and for aligning beats of the beat position information extracted by the beat extraction processing unit 12 on the basis of this beat period information.

Figure 2:
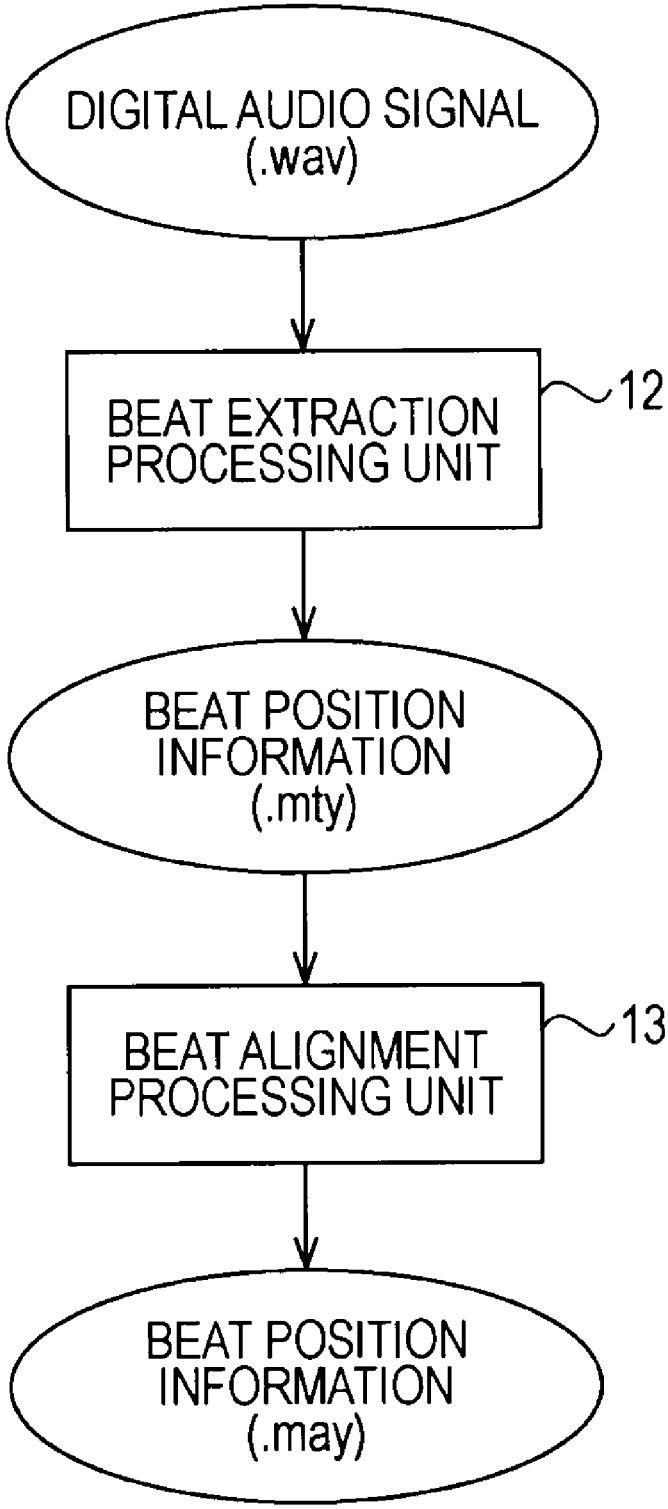
FIG. 2 is a functional block diagram showing an internal configuration of a beat extracting section.

As shown in FIG. 2, upon receiving a digital audio signal recorded in a .wav file, the beat extraction processing unit 12 extracts coarse beat position information from this digital audio signal and outputs the result as metadata recorded in an .mty file. In addition, the beat alignment processing unit 13 aligns the beat position information extracted by the beat extraction processing unit 12 using the entire metadata recorded in the .mty file or the metadata corresponding to a musical tune portion expected to have an identical tempo, and outputs the result as metadata recorded in a may file. This allows highly accurate extracted beat position information to be obtained step by step. Meanwhile, the beat extracting section 11 will be described in detail later.

The audio reproducing section 117 includes a D/A converter 117A, an output amplifier 117B, and a loudspeaker 117C. The I/O port 113 supplies a digital audio signal transferred through the system bus 100 to the D/A converter 117A included in the audio reproducing section 117. The D/A converter 117A converts the digital audio signal supplied from the I/O port 113 into an analog audio signal, and supplies the analog audio signal to the loudspeaker 117C through the output amplifier 117B. The loudspeaker 117C reproduces the analog audio signal supplied from the D/A converter 117A through this output amplifier 117B.

The display 112 constituted by, for example, an LCD (Liquid Crystal Display) or the like is connected to the display interface 111. The display 112 displays beat components and a tempo value extracted from the music data of the music content, for example. The display 112 also displays, for example, animated images or lyrics in synchronization with the music.

The communication network interface 107 is connected to the Internet 108. The music playback apparatus 10 accesses a server storing attribute information of the music content via the Internet 108 and sends an acquisition request for acquiring the attribute information using identification information of the music content as a retrieval key. The music playback apparatus stores the attribute information sent from the server in response to this acquisition request in, for example, a hard disc included in the HDD 121.

The attribute information of the music content employed by the music playback apparatus 10 includes information constituting a musical tune. The information constituting a musical tune includes information serving as a criterion that decides a so-called melody, such as information regarding sections of the musical tune, information regarding chords of the musical tune, a tempo in a unit chord, the key, the volume, and the beat, information regarding a musical score, information regarding chord progression, and information regarding lyrics.

Here, the unit chord is a unit of chord attached to a musical tune, such as a beat or a bar of the musical tune. In addition, the information regarding sections of a musical tune includes, for example, relative position information from the start position of the musical tune or the timestamp.

The beat extracting section 11 included in the music playback apparatus 10 in one embodiment to which the present invention is applied extracts beat position information of a rhythm of music on the basis of characteristics of a digital audio signal, which will be described below.

Figure 3:
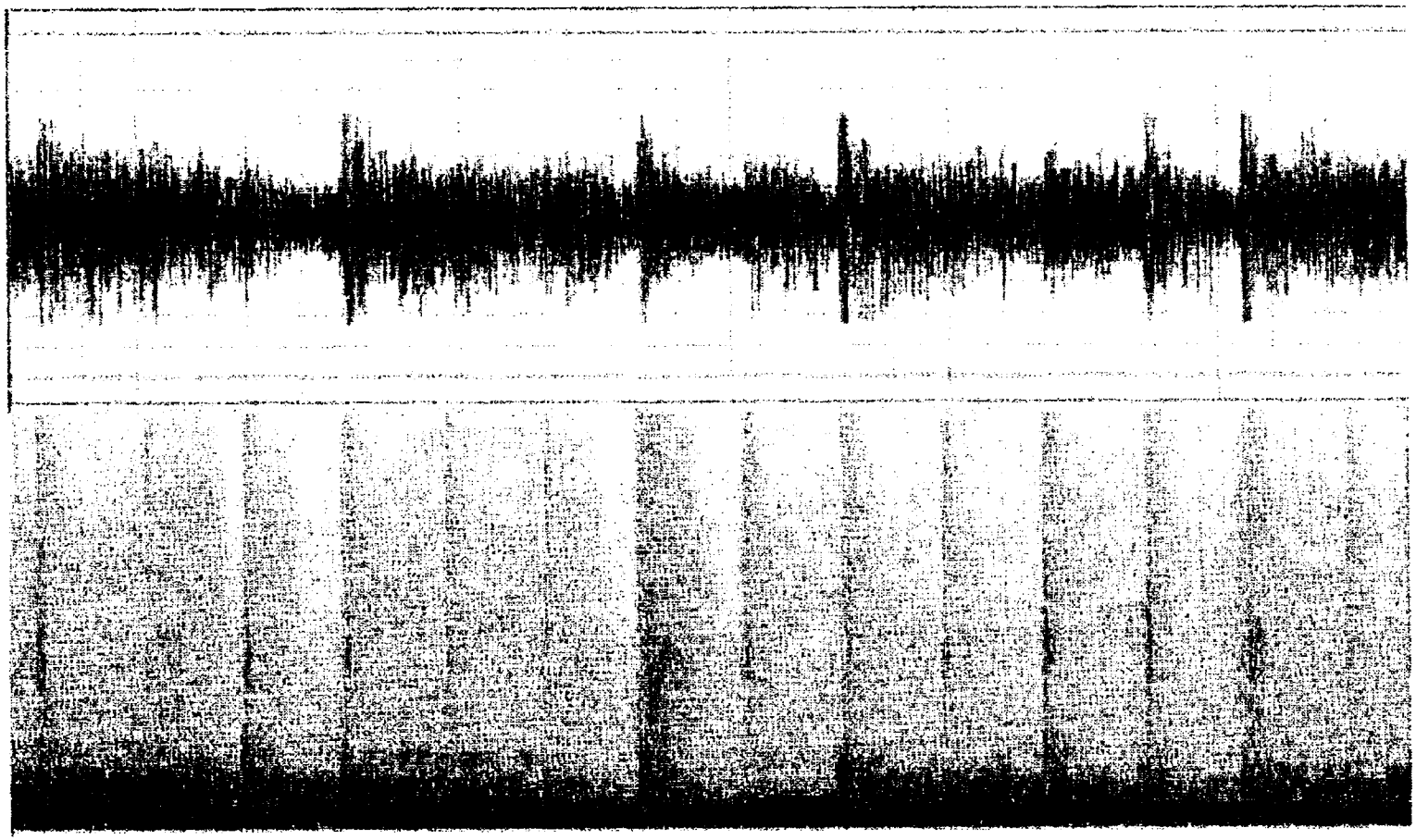

FIG. 3(A) shows an example of a time-series waveform of a digital audio signal. It is known that the time-series waveform shown in FIG. 3(A) sporadically includes portions indicating large instantaneous peaks. This portion indicating the large peak correspond to, for example, a part of beats of a drum.

Meanwhile, actually listening to music of the digital audio signal having the time-series waveform shown in FIG. 3(A) reveals that more beat components are included at substantially even intervals although such beat components are hidden in the time-series waveform of the digital audio signal having the time-series waveform shown in FIG. 3(A). Accordingly, the actual beat components of the rhythm of music cannot be extracted based only on the large peak values of the time-series waveform shown in FIG. 3(A).

FIG. 3(B) shows a spectrogram of the digital audio signal having the time-series waveform shown in FIG. 3(A). In the spectrogram of the digital audio signal shown in FIG. 3(B), it is known that beat components hidden in the time-series waveform shown in FIG. 3(A) can be seen as portions at which a power spectrum instantaneously changes significantly. Actually listening to the sound reveals that the portions at which the power spectrum instantaneously changes significantly in this spectrogram correspond to the beat components. The beat extracting section 11 considers the portions of this spectrogram at which the power spectrum instantaneously changes significantly as the beat components of the rhythm.

By extracting these beat components and measuring the beat period, a rhythm period and BPM (Beat Per Minutes) of music can be known.

Figure 4:
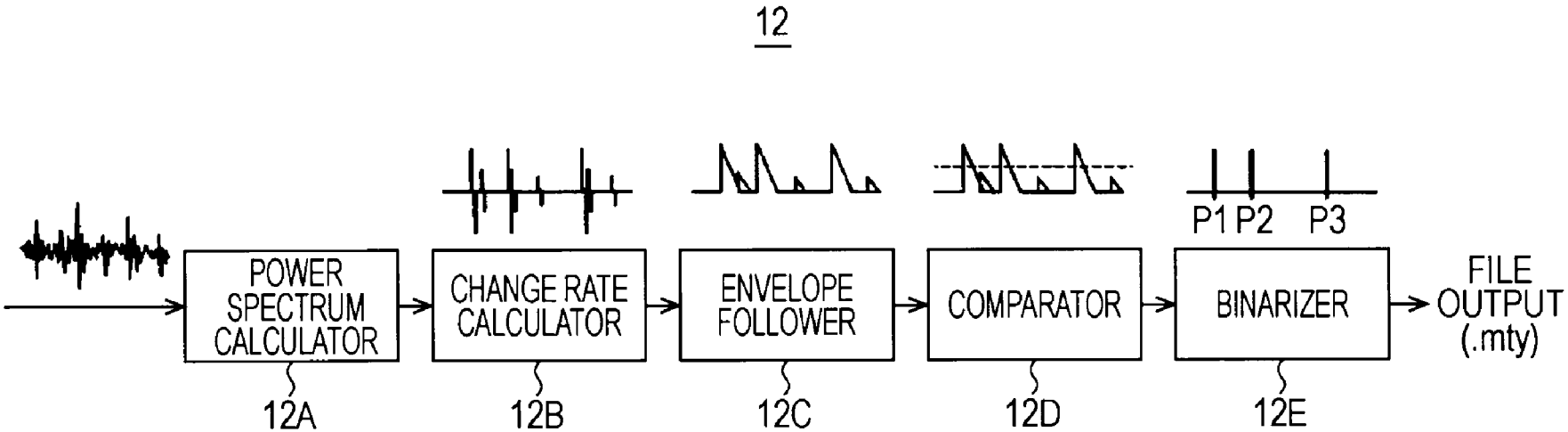
FIG. 4 is a functional block diagram showing an internal configuration of a beat extraction processing unit.

As shown in FIG. 4, the beat extraction processing unit 12 includes a power spectrum calculator 12A, a change rate calculator 12B, an envelope follower 12C, a comparator 12D, and a binarizer 12E.

Figure 5:
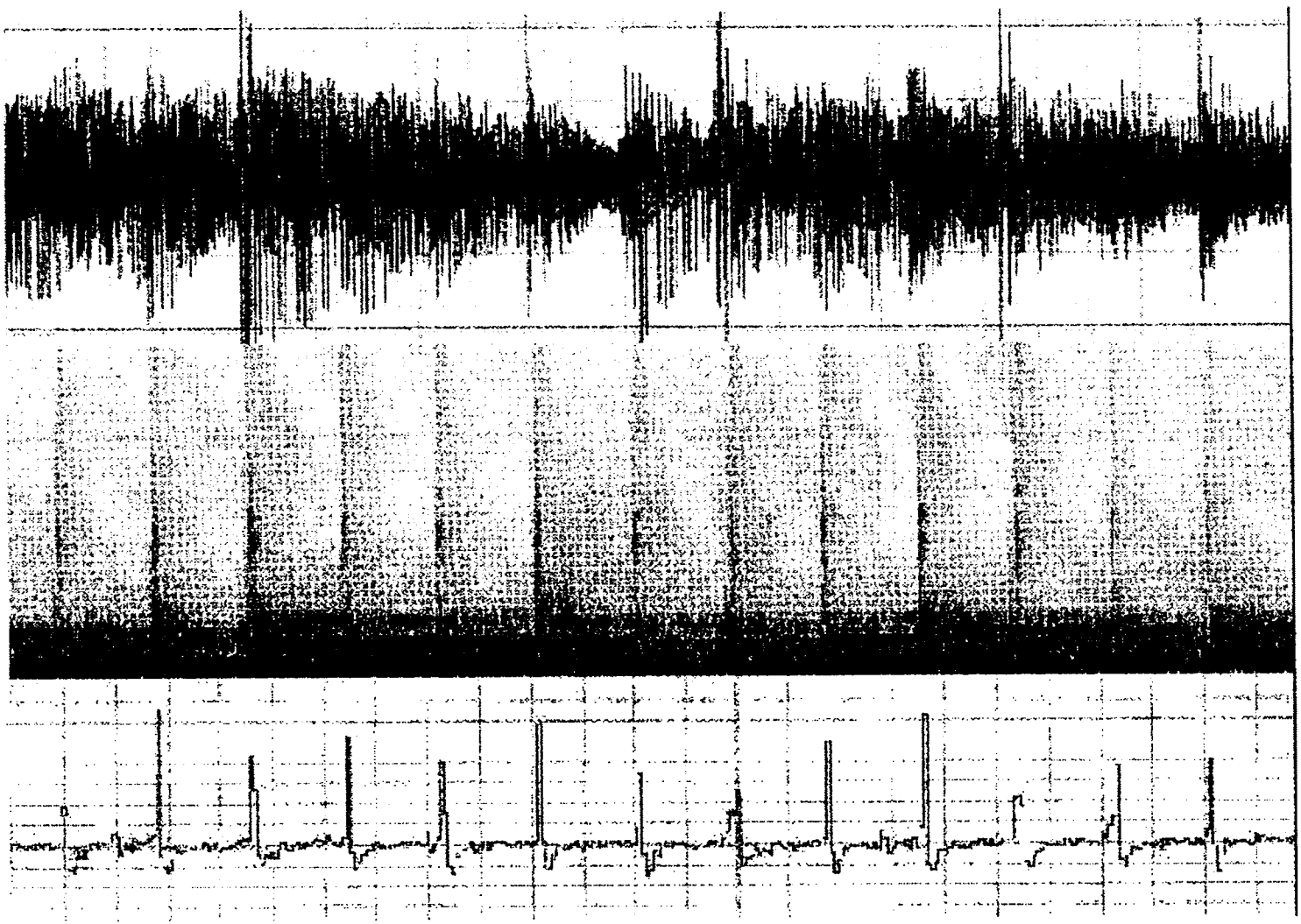
FIG. 5(A) is a diagram showing an example of a time-series waveform of a digital audio signal.
FIG. 5(B) is a diagram showing a spectrogram of this digital audio signal.
FIG. 5(C) is a diagram showing an extracted beat waveform of this digital audio signal.

The power spectrum calculator 12A receives a digital audio signal constituted by a time-series waveform of a musical tune shown in FIG. 5(A).

More specifically, the digital audio signal supplied from the audio data decoding section 104 is supplied to the power spectrum calculator 12A included in the beat extraction processing unit 12.

Since beat components cannot be extracted highly accurately from the time-series waveform, the power spectrum calculator 12A calculates a spectrogram shown in FIG. 5(B) using, for example, FFT (Fast Fourier Transform) on this time-series waveform.

When a sampling frequency of a digital audio signal input to the beat extraction processing unit 12 is 48 kHz, the resolution in this FFT operation is preferably set to be 5-30 msec in realtime with the number of samples being 512 samples or 1024 samples. Various values set in this FFT operation are not limited to these. In addition, it is generally preferable to perform the FFT operation while applying window function (apodization function), such as hanning or hamming, and overlapping the windows ("ranges").

The power spectrum calculator 12A supplies the calculated power spectrum to the change rate calculator 12B.

The change rate calculator 12B calculates a rate of change in the power spectrum supplied from the power spectrum calculator 12A. More specifically, the change rate calculator 12B performs a differentiation operation on the power spectrum supplied from the power spectrum calculator 12A, thereby calculating a rate of change in the power spectrum. By repeatedly performing the differentiation operation on the momentarily varying power spectrum, the change rate calculator 12B outputs a detection signal indicating an extracted beat waveform shown in FIG. 5(C). Here, peaks that rise in the positive direction of the extracted beat waveform shown in FIG. 5(C) are considered as beat components.

Upon receiving the detection signal from the change rate calculator 12B, the envelope follower 12C applies a hysteresis characteristic with an appropriate time constant to this detection signal, thereby removing chattering from this detection signal. The envelope follower supplies this chattering-removed detection signal to the comparator 12D.

The comparator 12D sets an appropriate threshold, eliminates a low-level noise from the detection signal supplied from the envelope follower 12C, and supplies the low-level-noise-eliminated detection signal to the binarizer 12E.

The binarizer 12E performs a binarization operation to extract only the detection signal having a level equal to or higher than the threshold from the detection signal supplied from the comparator 12D. The binarizer outputs beat position information indicating time positions of beat components constituted by P1, P2, and P3 as metadata recorded in an .mty file.

In this manner, the beat extraction processing unit 12 extracts beat position information from a time-series waveform of a digital audio signal and outputs the beat position information as metadata recorded in an .mty file. Meanwhile, each element included in this beat extraction processing unit 12 has internal parameters and an effect of an operation of each element is modified by changing each internal parameter. This internal parameter is automatically optimized, as described later. However, the internal parameter may be set manually by, for example, a user's manual operation on the operation input section 110.

Figure 6:
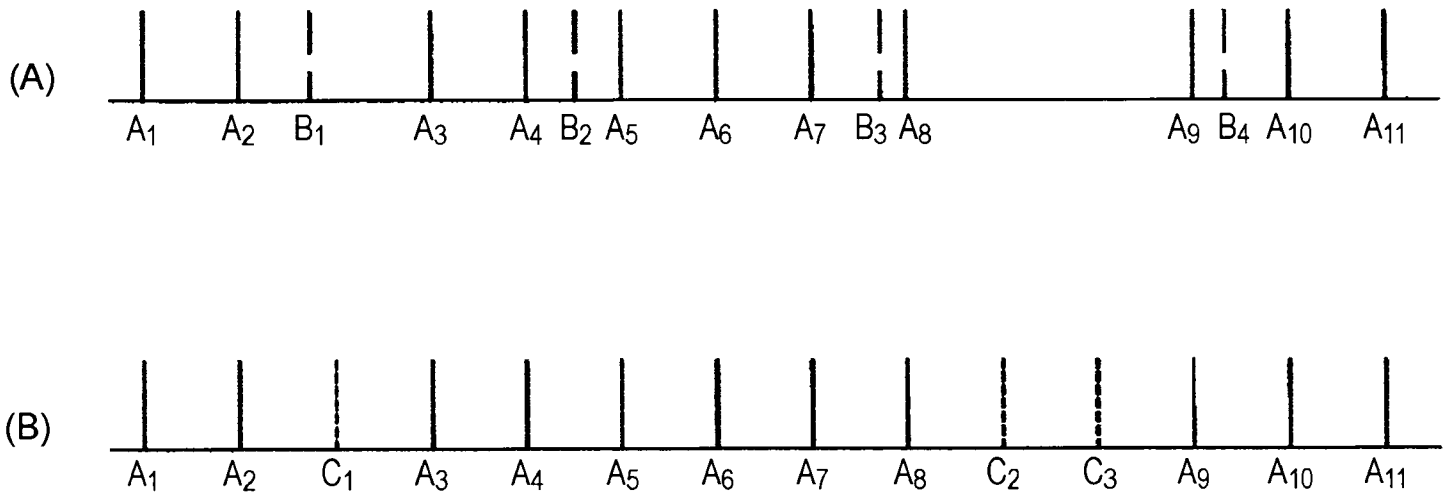

Beat intervals of beat position information of a musical tune extracted and recorded in an .mty file as metadata by the beat extraction processing unit 12 are often uneven as shown in FIG. 6(A), for example.

The beat alignment processing unit 13 performs an alignment process on the beat position information of a musical tune or musical tune portions expected to have an identical tempo in the beat position information extracted by the beat extraction processing unit 12.

The beat alignment processing unit 13 extracts even-interval beats, such as, for example, those shown by A1 to A11 of FIG. 6(A), timed at even time intervals, from the metadata of the beat position information extracted and recorded in the .mty file by the beat extraction processing unit 12 but does not extract uneven-interval beats, such as those shown by B1 to B4. In the embodiment, the even-interval beats are timed at even intervals of a quarter note.

The beat alignment processing unit 13 calculates a highly accurate average period T from the metadata of the beat position information extracted and recorded in the .mty file by the beat extraction processing unit 12, and extracts, as even-interval beats, beats having a time interval equal to the average period T.

Here, the extracted even-interval beats alone cause a blank period shown in FIG. 6(A). Accordingly, as shown in FIG. 6(B), the beat alignment processing unit 13 newly adds interpolation beats, such as those shown by C1 to C3, at positions where the even-interval beats would exist. This allows the beat position information of all beats timed at even intervals to be obtained.

The beat alignment processing unit 13 defines beats that are substantially in phase with the even-interval beats as in beats and extracts them. Here, the in beats are beats synchronized with actual music beats and also include the even-interval beats. On the other hand, the beat alignment processing unit 13 defines beats that are out of phase with the even-interval beats as out beats and excludes them. The out beats are beats that are not synchronized with the actual music beats (quarter note beats). Accordingly, the beat alignment processing unit 13 needs to distinguish the in beats from the out beats.

Figure 7:
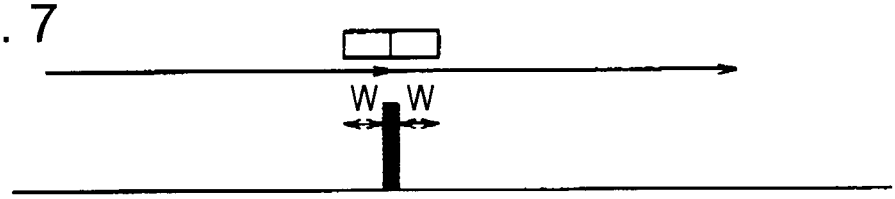
FIG. 7 is a diagram showing a window width in which whether a specific beat is an in beat or not is determined.

More specifically, as a method for determining whether a certain beat is an in beat or an out beat, the beat alignment processing unit 13 defines a predetermined window width W centered on the even-interval beat as shown in FIG. 7. The beat alignment processing unit 13 determines that a beat included in the window width W is an in beat and that a beat not included in the window width W is an out beat.

Additionally, when no even-interval beats are included in the window width W, the beat alignment processing unit 13 adds an interpolation beat, which is a beat to interpolate the even-interval beats.

Figure 8:
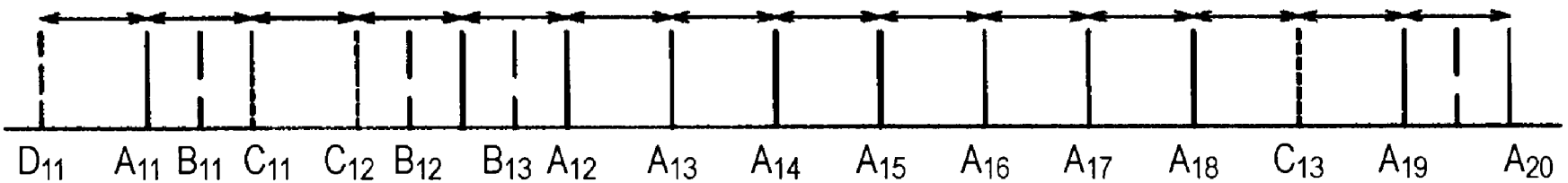
FIG. 8 is a diagram showing beat intervals of beat position information.

More specifically, for example as shown in FIG. 8, the beat alignment processing unit 13 extracts even-interval beats, such as those shown by A11 to A20, and an in beat D11, which is a beat substantially in phase with the even-interval beat A11, as the in beats. The beat alignment processing unit also extracts interpolation beats, such as those shown by C11 to C13. In addition, the beat alignment processing unit 13 does not extract out beats such as those shown by B11 to B13 as quarter note beats.

Since music beats actually fluctuate temporally, the number of in beats extracted from music having a large fluctuation in this determination decreases. As a result, a problem of causing an extraction error called beat slip occurs.

Accordingly, by resetting the value of the window width W larger for music having a large fluctuation, the number of extracted in beats increases and the extraction error can be reduced. The window width W may be generally a constant value. However, for a musical tune having an extremely large fluctuation, the window width can be adjusted as a parameter, such as increasing the value.

The beat alignment processing unit 13 assigns, as the metadata, a beat attribute of the in beat included in the window width W or the out beat not included in the window width W. In addition, if no extracted beat exists within the window width W, the beat alignment processing unit 13 automatically adds an interpolation beat and assigns, as the metadata, a beat attribute of this interpolation beat as well. Through this operation, the beat-information-constituting metadata including the beat information, such as the above-described beat position information and the above-described beat attribute, is recorded in a metadata file (.may). Meanwhile, each element included in this beat alignment processing unit 13 has internal parameters, such as the basic window width W, and an effect of an operation is modified by changing each internal parameter.

As described above, the beat extracting section 11 can automatically extract significantly highly accurate beat information from a digital audio signal by performing two-step data processing in the beat extraction processing unit and the beat alignment processing unit 13. The beat extracting section performs not only the determination of whether a beat is an in beat or an out beat but also addition of the appropriate beat interpolation process, thereby being able to obtain the beat information of quarter note intervals over an entire musical tune.

A method for calculating an amount of various musical characteristics obtained along with the beat position information extracted by the beat extracting section 11 according to the present invention in the music playback apparatus 10 will be described next.

Figure 9:
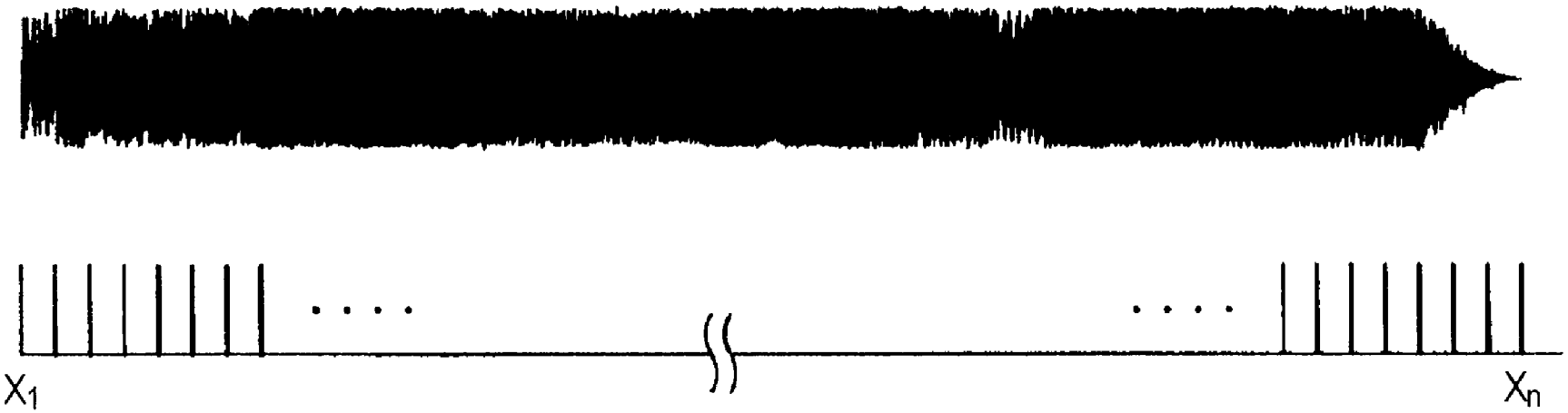
FIG. 9 is a diagram showing a total number of beats calculated on the basis of beat position information extracted by a beat extracting section.

As shown in FIG. 9, the music playback apparatus 10 can calculate a total number of beats on the basis of beat position information of a first beat X1 and a last beat Xn extracted by the beat extracting section 11 using equation (1) shown below.

$$\text{Total number of beats}=\text{Total number of in beats}+\text{Total number of interpolation beats} \quad (1)$$

In addition, the music playback apparatus 10 can calculate the music tempo (an average BPM) on the basis of the beat position information extracted by the beat extracting section 11 using equation (2) and equation (3) shown below.

$$\text{Average beat period[samples]}=(\text{Last beat position}-\text{First beat position})/(\text{Total number of beats}-1) \quad (2)$$

$$\text{Average BPM[bpm]}=\text{Sampling frequency}/\text{Average beat period}\times 60 \quad (3)$$

In this manner, the music playback apparatus 10 can obtain the total number of beats and the average BPM using the simple four basic operations of arithmetic. This allows the music playback apparatus 10 to calculate a tempo of a musical tune at a high speed and with a low load using this calculated result. Meanwhile, the method for determining a tempo of a musical tune is not limited to this one.

Since the calculation accuracy depends on the audio sampling frequency in this calculation method, a significantly highly accurate value of eight significant figures can be generally obtained. In addition, even if the extraction error occurs during the beat extraction process of the beat alignment processing unit 13, the obtained BPM is a highly accurate value since an error rate thereof is between a fraction of several hundredths and a fraction of several thousandths in this calculation method.

Figure 10:
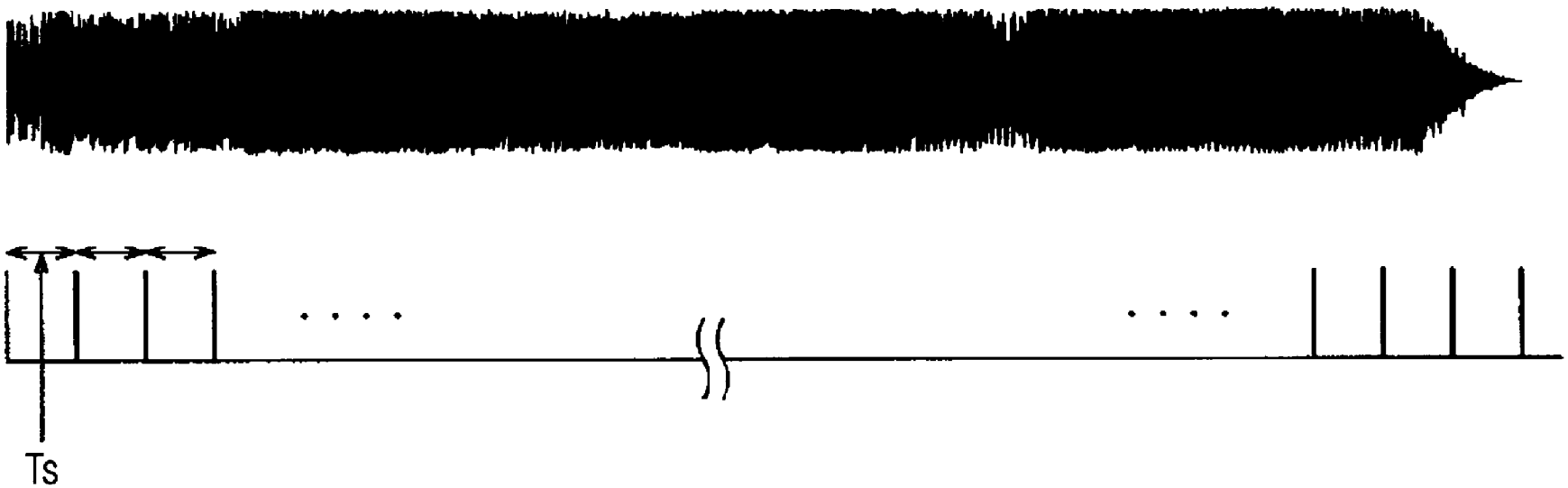
FIG. 10 is a diagram showing a total number of beats and an instantaneous beat period.

In addition, the music playback apparatus 10 can calculate instantaneous BPM indicating an instantaneous fluctuation of a tempo of a musical tune, which cannot be realized hitherto, on the basis of the beat position information extracted by the beat extracting section 11. As shown in FIG. 10, the music playback apparatus 10 sets the time interval of the even-interval beats as an instantaneous beat period Ts and calculates the instantaneous BPM using equation (4) given below.

$$\text{Instantaneous BPM[bpm]}=\text{Sampling frequency}/\text{Instantaneous beat period } Ts\times 60 \quad (4)$$

The music playback apparatus 10 graphs out this instantaneous BPM for every single beat and displays the graph on the display 112 through the display interface 111. Users can grasp a distribution of this instantaneous BPM as a distribution of the fluctuation of the temp of the music that the users are actually listening to and can utilize it for, for example, rhythm training, grasp of a performance mistake caused during recording of the musical tune, or the like.

Figure 11:
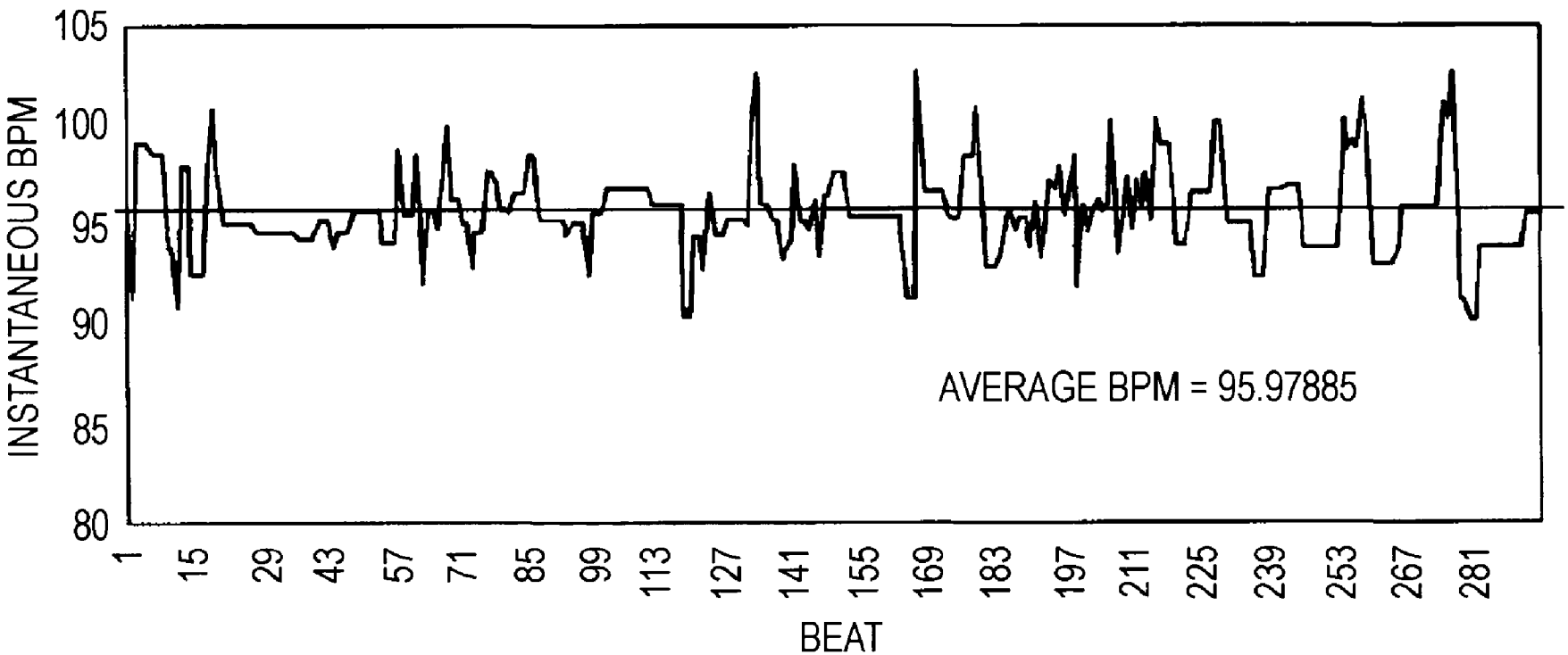
FIG. 11 is a graph showing instantaneous BPM against beat numbers in a live-recorded musical tune.
Figure 12:
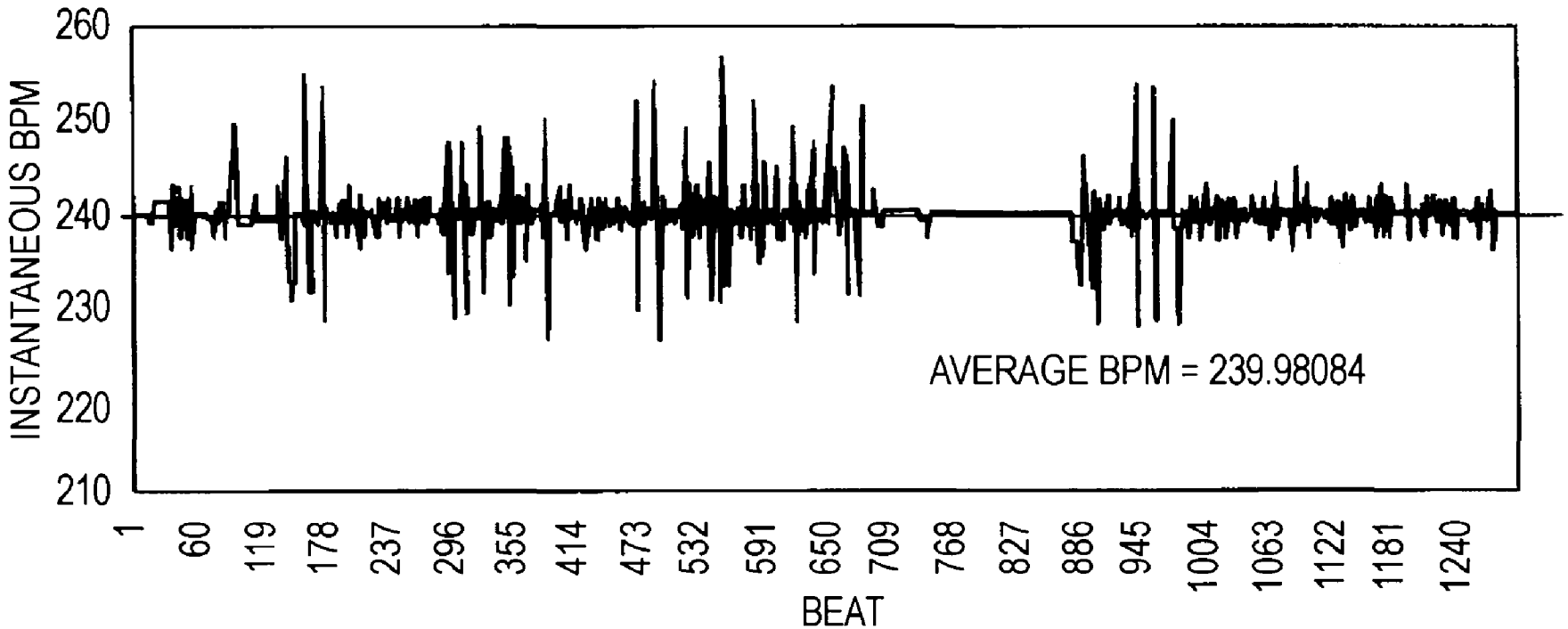
FIG. 12 is a graph showing instantaneous BPM against beat numbers in a so-called computer-synthesized-recorded musical tune.

FIG. 11 is a graph showing the instantaneous BPM against beat numbers of a live-recorded musical tune. In addition, FIG. 12 is a graph showing the instantaneous BPM against beat numbers of a so-called computer-synthesized-recorded musical tune. As is clear from comparison of the graphs, the computer-recorded musical tune has a smaller fluctuation time width than the live-recorded musical tune. This is because the computer-recorded musical tune has a characteristic that the tempo changes therein are less by comparison. By using this characteristic, it is possible to automatically determine whether a certain musical tune is live-recorded or computer-recorded, which has been impossible.

A method for making the accuracy of the beat position information extracting process higher will be described next.

Since the metadata indicating the beat position information extracted by the beat extracting section 11 is generally data extracted according to an automatic recognition technique of a computer, this beat position information includes more or less extraction errors. In particular, depending on musical tunes, there are those having beats significantly fluctuate unevenly and those extremely lacking the beat sensation.

Accordingly, the beat alignment processing unit 13 assigns, to metadata supplied from the beat extraction processing unit 12, a reliability index value indicating the reliability of this metadata and automatically determines the reliability of the metadata. This reliability index value is defined as, for example, a function that is inversely proportional to a variance of the instantaneous BPM as shown by the following equation (5).

$$\text{Reliability index}\propto 1/\text{Variance of instantaneous BPM} \quad (5)$$

This is because there is a characteristic that the variance of the instantaneous BPM generally increases when an extraction error is caused in the beat extraction process. That is, the reliability index value is defined to increase as the variance of the instantaneous BPM becomes smaller.

A method for extracting the beat position information more accurately on the basis of this reliability index value will be described using flowcharts of FIG. 13 and FIG. 14.

It is not too much to say automatically obtaining specific beat position information at accuracy of 100% from various musical tunes including beat position information extraction errors is impossible. Accordingly, users can manually correct the beat position information extraction errors through a manual operation. If the extraction errors can be easily found and the error parts can be corrected, the correction work becomes more efficient.

Figure 13:
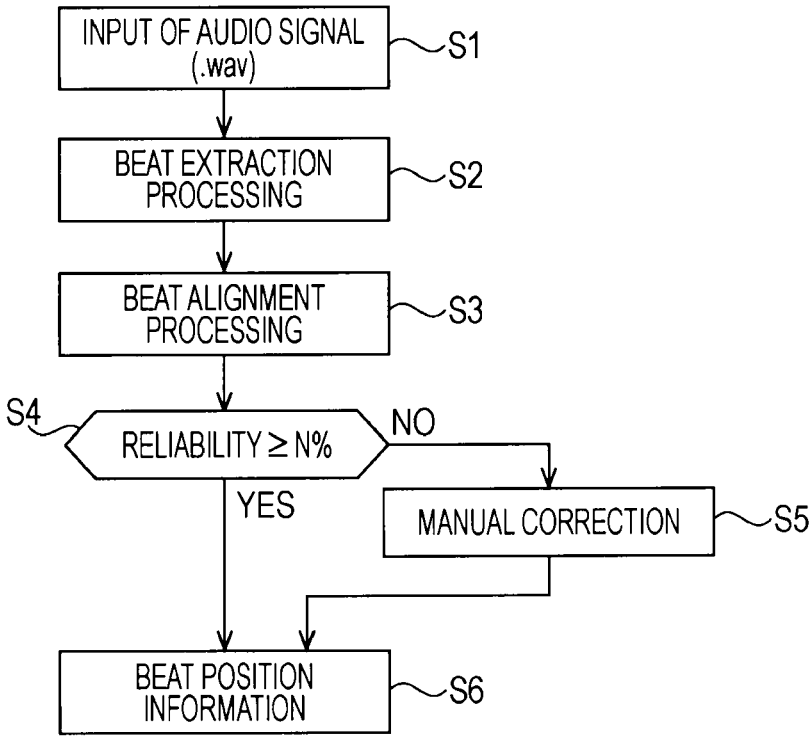
FIG. 13 is a flowchart showing an example of a procedure of correcting beat position information in accordance with a reliability index value.

FIG. 13 is a flowchart showing an example of a procedure of manually correcting the beat position information on the basis of the reliability index value.

At STEP S1, a digital audio signal is supplied to the beat extraction processing unit 12 included in the beat extracting section 11 from the I/O port 113.

At STEP S2, the beat extraction processing unit 12 extracts beat position information from the digital audio signal supplied from the I/O port 113 and supplies the beat position information to the beat alignment processing unit 13 as metadata recorded in an .mty file.

At STEP S3, the beat alignment processing unit 13 performs alignment processing on beats constituting the beat position information supplied from the beat extraction processing unit 12.

At STEP S4, the beat alignment processing unit 13 determines whether or not the reliability index value assigned to the alignment-processed metadata is equal to or higher than a threshold N(%). If the reliability index value is equal to or higher than N(%) at this STEP S4, the process proceeds to STEP S6. If the reliability index value is lower than N(%), the process proceeds to STEP S5.

At STEP S5, a manual correction for the beat alignment processing is performed by a user with an authoring tool (not shown) included in the music playback apparatus 10.

At STEP S6, the beat alignment processing unit 13 supplies the beat-alignment-processed beat position information to the I/O port 114 as metadata recorded in a .may file.

In addition, by changing an extraction condition of the beat position information on the basis of the above-described reliability index value, it is possible to extract the beat position information more highly accurately.

Figure 14:
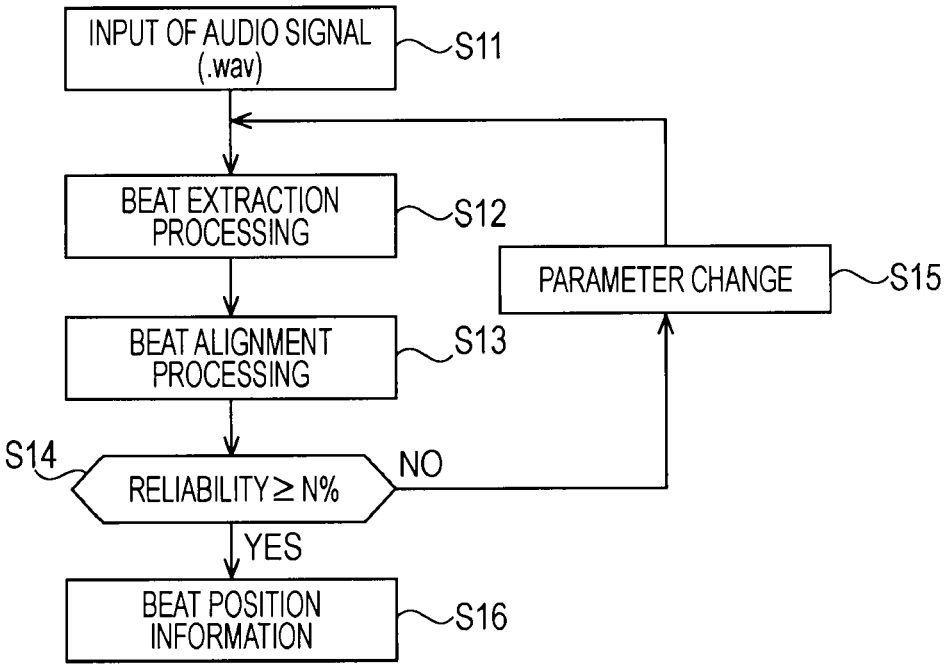
FIG. 14 is a flowchart showing an example of a procedure of automatically optimizing a beat extraction condition.

FIG. 14 is a flowchart showing an example of a procedure of specifying a beat extraction condition.

A plurality of internal parameters that specify the extraction condition exists in the beat extraction process in the beat extracting section 11 and the extraction accuracy changes depending on the parameter values. Accordingly, in the beat extracting section 11, the beat extraction processing unit 12 and the beat alignment processing unit 13 prepare a plurality of sets of internal parameters beforehand, perform the beat extraction process for each parameter set, and calculate the above-described reliability index value.

At STEP S11, a digital audio signal is supplied to the beat extraction processing unit 12 included in the beat extracting section 11 from the I/O port 113.

At STEP S12, the beat extraction processing unit 12 extracts beat position information from the digital audio signal supplied from the I/O port 113 and supplies the beat position information to the beat alignment processing unit 13 as metadata recorded in an .mty file.

At STEP S13, the beat alignment processing unit 13 performs the beat alignment process on the metadata supplied from the beat extraction processing unit 12.

At STEP S14, the beat alignment processing unit 13 determines whether or not the reliability index value assigned to the alignment-processed metadata is equal to or higher than a threshold N(%). If the reliability index value is equal to or higher than N(%) at this STEP S14, the process proceeds to STEP S16. If the reliability index value is lower than N(%), the process proceeds to STEP S15.

At STEP S15, each of the beat extraction processing unit 12 and the beat alignment processing unit 13 changes parameters of the above-described parameter sets and the process returns to STEP S12. After STEP S12 and STEP S13, the determination of the reliability index value is performed again at STEP S14.

STEP S12 to STEP S15 are repeated until the reliability index value becomes equal to or higher than N(%) at STEP S14.

Through such steps, an optimum parameter set can be specified and the extraction accuracy of the automatic beat extraction process can be significantly improved.

As described above, according to the music playback apparatus 10 including a beat extracting device according to the present invention, an audio waveform (sampling sound source), such as PCM, not having timestamp information, such as beat position information, can be musically synchronized with other media. In addition, since the data size of the timestamp information, such as the beat position information, is between several Kbytes and several tens Kbytes and is significantly small, as being a fraction of several thousandths of the data size of the audio waveform, the memory capacity and the processing steps can be reduced, which thus allows users to handle it significantly easily.

As described above, according to the music playback apparatus 10 including a beat extracting device according to the present invention, it is possible to accurately extract beats over an entire musical tune from music whose tempo changes or music whose rhythm fluctuates and further to create a new entertainment by synchronizing the music with other media.

Meanwhile, it is obvious that the present invention is not limited only to the above-described embodiments and can be variously modified within a scope not departing from the spirit of the present invention.

For example, a beat extracting device according to the present invention can be applied not only to the personal computer or the portable music playback apparatus described above but also to various kinds of apparatuses or electronic apparatuses.

According to the present invention, beat position information of a rhythm of a musical tune is extracted, beat period information is generated using this extracted and obtained beat position information, and beats of the extracted beat position information are aligned on the basis of this beat period information, whereby the beat position information of a specific musical note can be extracted highly accurately from the entire musical tune.

The invention claimed is:

1. A beat extracting device comprising:

beat extraction processing means for extracting beat position information of a rhythm of a musical tune; and beat alignment processing means for generating beat period information using the beat position information extracted and obtained by the beat extraction processing means and for aligning beats of the beat position information extracted by the beat extraction processing means on the basis of the beat period information, wherein the beat alignment processing means defines a window width centered on a beat, said window width matches a beat period of the beat period information in terms of time and extracts only a beat existing within the window width.

2. The beat extracting device according to claim 1, wherein the beat alignment processing means uses the beat position information extracted from the entire musical tune or from a portion of the musical tune that is expected to have an identical tempo.

3. The beat extracting device according to claim 1, wherein the beat extraction processing means includes:

power spectrum calculating means for calculating a power spectrum of the music signal from a time-series waveform of a music signal of the music; and change amount calculating means for calculating an amount of change in the power spectrum calculated by the power spectrum calculating means and outputting the calculated amount of change.

4. The beat extracting device according to claim 1, wherein, when no beat exists in the window width, the beat alignment processing means adds a new beat in the window width and extracts the added beat.

5. The beat extracting device according to claim 1, wherein the beat alignment processing means calculates an index value indicating a reliability of the beat-aligned beat position information and determines whether or not the index value is equal to or higher than a predetermined threshold.

6. The beat extracting device according to claim 5, wherein the beat extraction processing means and the beat alignment processing means have internal parameters that specify a beat extraction processing condition and a beat alignment processing condition, respectively, and repeatedly change the respective internal parameters until the index value becomes equal to or higher than the predetermined threshold.

7. The beat extracting device according to claim 5, further comprising: correction means for manually correcting the beat position information aligned by the beat alignment processing means until the index value becomes equal to or higher than the predetermined threshold.

8. The beat extracting device according to claim 5, wherein the index value is a function that is inversely proportional to a variance of instantaneous BPM between beats of the beat position information.

9. A beat extracting method comprising:

a beat extraction processing step of extracting beat position information of a rhythm of a musical tune; and a beat alignment processing step of generating beat period information using the beat position information extracted and obtained at the beat extraction processing step and of aligning beats of the beat position information extracted at the beat extraction processing step on the basis of the beat period information, wherein at the beat alignment processing step, a window width centered on a beat that matches a beat period of the beat period information in terms of time is defined and only a beat existing within the window width is extracted.

10. The beat extracting method according to claim 9, wherein, at the beat alignment processing step, the beat position information extracted from the entire musical tune or from a portion of the musical tune that is expected to have an identical tempo is used.

11. The beat extracting method according to claim 9, wherein the beat extraction processing step includes:

a power spectrum calculating step of calculating a power spectrum of the music signal from a time-series waveform of a music signal of the music; and a change amount calculating step of calculating an amount of change in the power spectrum calculated at the power spectrum calculating step and outputting the calculated amount of change.

12. The beat extracting method according to claim 9, wherein, when the beat does not exist in the window width, a new beat is added in the window width and the added beat is extracted at the beat alignment processing step.

13. The beat extracting method according to claim 9, wherein, at the beat alignment processing step, an index value indicating a reliability of the beat-aligned beat position information is calculated and whether or not the index value is equal to or higher than a predetermined threshold is determined.

14. The beat extracting method according to claim 13, wherein internal parameters that specify a beat extraction processing condition and a beat alignment processing condition exist at the beat extraction processing step and the beat alignment processing step, respectively, and the respective internal parameters are repeatedly changed until the index value becomes equal to or higher than the predetermined threshold.

15. The beat extracting method according to claim 14, further comprising: a correction step of manually correcting the beat position information aligned at the beat alignment processing step until the index value becomes equal to or higher than the predetermined threshold.

16. The beat extracting method according to claim 13, wherein the index value is a function that is inversely proportional to a variance of instantaneous BPM between beats of the beat position information.

* * * * *